US010160235B2

(12) United States Patent
Tomioka et al.

(10) Patent No.: US 10,160,235 B2
(45) Date of Patent: Dec. 25, 2018

(54) PRINTING DEVICE

(71) Applicant: MIMAKI ENGINEERING CO., LTD., Nagano (JP)

(72) Inventors: Kota Tomioka, Nagano (JP); Yoshikazu Furukawa, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/729,684

(22) Filed: Oct. 11, 2017

(65) Prior Publication Data

US 2018/0099513 A1 Apr. 12, 2018

(30) Foreign Application Priority Data

Oct. 11, 2016 (JP) ..... 2016-200219

(51) Int. Cl.

| | |
|---|---|
| ***B41J 11/42*** | (2006.01) |
| ***B41J 11/44*** | (2006.01) |
| ***B41J 13/08*** | (2006.01) |
| ***B41J 15/04*** | (2006.01) |
| ***B41J 11/00*** | (2006.01) |
| *B65H 7/02* | (2006.01) |
| *B41J 3/407* | (2006.01) |

(52) U.S. Cl.

CPC ..... *B41J 11/425* (2013.01); *B41J 11/007* (2013.01); *B41J 11/42* (2013.01); *B41J 11/44* (2013.01); *B41J 13/08* (2013.01); *B41J 15/048* (2013.01); *B41J 3/4078* (2013.01); *B65H 7/02* (2013.01)

(58) Field of Classification Search

USPC ..... 347/9, 16, 19

See application file for complete search history.

(56) References Cited

U.S. PATENT DOCUMENTS

| | | | | |
|---|---|---|---|---|
| 7,905,346 | B2 * | 3/2011 | Enomoto | B41J 11/007 198/807 |
| 2010/0277537 | A1 * | 11/2010 | Maekawara | B41J 11/007 347/16 |
| 2012/0182347 | A1 * | 7/2012 | Shimizu | B41J 11/007 347/16 |
| 2016/0152051 | A1 * | 6/2016 | Ito | B41J 11/0045 347/16 |

FOREIGN PATENT DOCUMENTS

| | | |
|---|---|---|
| JP | 2015013455 | 1/2015 |

OTHER PUBLICATIONS

"Search Report of Europe Counterpart Application", dated Mar. 7, 2018, p. 1-7.

* cited by examiner

*Primary Examiner* — Lam Nguyen
(74) *Attorney, Agent, or Firm* — JCIPRNET

(57) ABSTRACT

To provide a printing device such as an inkjet device capable of transporting a recording medium at satisfactory precision with a simple configuration. The inkjet device includes a feed amount correcting section that corrects a feed amount of a recording medium, and a control section that controls the feed amount correcting section. The feed amount correcting unit includes a moving section that moves with a movement of the recording medium in a transporting direction and a displacement sensor section that detects a displacement amount of the moving section, and the control section controls the feed amount of the recording medium based on a difference between a feed amount acquired at a time of printing and a set feed amount set in advance.

20 Claims, 8 Drawing Sheets

PRINTING DEVICE

CROSS REFERENCE TO RELATED APPLICATIONS

This application claims the priority benefit of Japanese Patent Application No. 2016-200219, filed on Oct. 11, 2016. The entirety of the above-mentioned patent application is hereby incorporated by reference herein and made a part of this specification.

TECHNICAL FIELD

The present disclosure relates to a printing device.

DESCRIPTION OF THE BACKGROUND ART

An inkjet recording device that mounts a recording medium such as a fabric on a belt, transports the recording medium in a feeding direction (transporting direction) by moving the belt, and discharges ink from an inkjet head to the transported recording medium to carry out printing is known (see e.g., Japanese Unexamined Patent Publication No. 2015-13455). Such an inkjet recording device includes a detecting section that continuously detects a movement amount of a gripping unit for gripping a belt, where a movement amount of the belt is detected based on the movement amount detected by the detecting section. An encoder, a linear scale, or the like, for example, is used for the detecting section.

Patent Literature 1: Japanese Unexamined Patent Publication No. 2015-13455

SUMMARY

When moving the belt only by a predetermined feed amount, the movement amount during the movement of the belt does not need to be measured as the movement by the predetermined feed amount merely needs to be detected. However, the inkjet recording device of Japanese Unexamined Patent Publication No. 2015-13455 needs to arrange the detecting section on the gripping unit to detect the movement amount of the belt as the gripping unit is moved with the moving belt, the movement amount is measured by the detecting section, and the measured movement amount is detected as the movement amount of the belt, and hence simplification of the configuration is difficult.

The present disclosure thus provides a printing device capable of transporting a recording medium at satisfactory precision with a simple configuration.

A printing device of the present disclosure includes: a transporting section that transports a recording medium in a transporting direction; a printing section that carries out printing on the recording medium which is transported; a feed amount correcting section that corrects a feed amount in the transporting direction of the recording medium transported by the transporting section; and a control section that controls the transporting section and the feed amount correcting section; where the feed amount correcting section includes a moving section that moves with a movement of the recording medium in the transporting direction, and a displacement detecting section that detects a displacement amount of the moving section, a distance between the displacement detecting section at an initial position before a transportation and the moving section at an initial position before a transportation is a set feed amount set in advance, and the control section controls the feed amount of the recording medium based on a difference between the feed amount acquired at a time of printing of the printing section and the set feed amount set in advance.

According to such a configuration, the feed amount of the recording medium can be corrected based on the difference of the feed amount acquired at the time of printing and the set feed amount. Then, the moving section is moved toward the displacement detecting section, and the transportation of the recording medium by the transporting section is controlled by the control section so that the recording medium becomes the set feed amount based on the displacement amount detected by the displacement detecting section to transport the recording medium at satisfactory precision. In this case, the displacement sensor such as the linear scale, or the encoder, is arranged on the moving section so that the distance during the movement does not need to be measured, whereby the configuration can be simplified, and the cost can be reduced by the simplified configuration. Furthermore, as the recording medium is transported at satisfactory precision by the transporting section, the printing can be carried out with satisfactory precision on the recording medium of after the transportation by the printing section, and occurrence of print failure such as print line can be suppressed.

The set feed amount is preferably set according to a number of paths at the time of the printing of the printing section during a time of initial setting.

According to such a configuration, the recording medium can be transported at the set feed amount suited for the number of paths.

The control section preferably carries out position correction on the initial position of the displacement detecting section based on the difference between the feed amount acquired at the time of printing of the printing section and the set feed amount set in advance, so as to obtain the set feed amount after a correction, the moving section is preferably moved toward the displacement detecting section at a time of the transportation, and the control section preferably controls the transporting section, so that the feed amount of the recording medium becomes the set feed amount after the correction based on the displacement amount detected by the displacement detecting section of the moving section which moves.

According to such a configuration, the set feed amount can be corrected by position correcting the initial position of the displacement detecting section based on the difference. Thus, the feed amount of the recording medium can be corrected easily and at satisfactory precision by simply correcting the position of the displacement detecting section.

The printing device preferably further includes a displacement origin point detecting section that detects an origin point position of the displacement detecting section, where a distance between the displacement detecting section at the origin point position and the moving section at the initial position is preferably an origin point defined distance, and the control section preferably calculates a differential movement amount obtained by subtracting the set feed amount from the origin point defined distance, and sets a position to where the displacement detecting section is moved from the origin point position by the differential movement amount as the initial position of the displacement detecting section.

According to such a configuration, the displacement detecting section can be located at the initial position to become the set feed amount by moving the displacement detecting section by the differential movement amount.

The control section preferably decelerates a post-detection transporting speed after a displacement detection of the moving section in comparison with a pre-detection transporting speed before a displacement detection of the moving section based on the set feed amount during a transportation operating of the recording medium.

According to such a configuration, the detection of the displacement amount of the moving section by the displacement detecting section can be stably carried out by decelerating the moving section at the time of detection by the displacement detecting section, and the movement of the moving section can be suppressed from exceeding and the moving section from physically making contact with another portion.

Furthermore, the displacement detecting section preferably includes a turning shaft, and a claw portion that rotates with the turning shaft as the center, and the control section preferably detects a movement amount of the claw portion in the transporting direction as the displacement amount.

According to such a configuration, the moving section is brought into contact with the claw portion so that the claw portion is moved with the turning shaft as the center, whereby the movement amount in the transporting direction can be detected as the displacement amount.

DETAILED DESCRIPTION OF EMBODIMENTS

Hereinafter, an embodiment according to the present disclosure will be described in detail based on the drawings. The present disclosure is not to be limited by such an embodiment. Components in the following embodiment include components that can be replaced by those skilled in the art and are easy, or are substantially the same.

Embodiment

Figure 1:
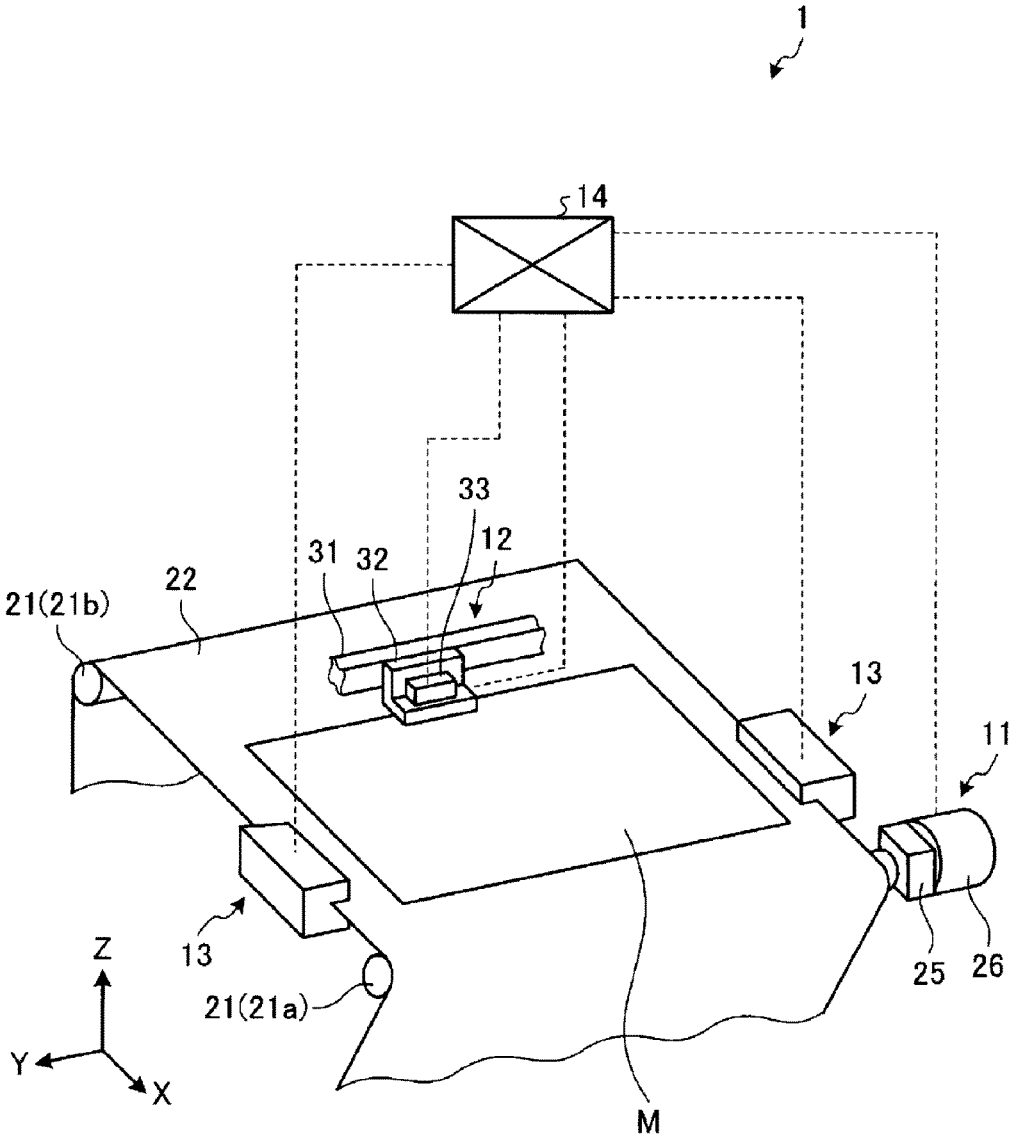
FIG. 1 is a schematic configuration view showing an inkjet device according to the present embodiment.
Figure 2:
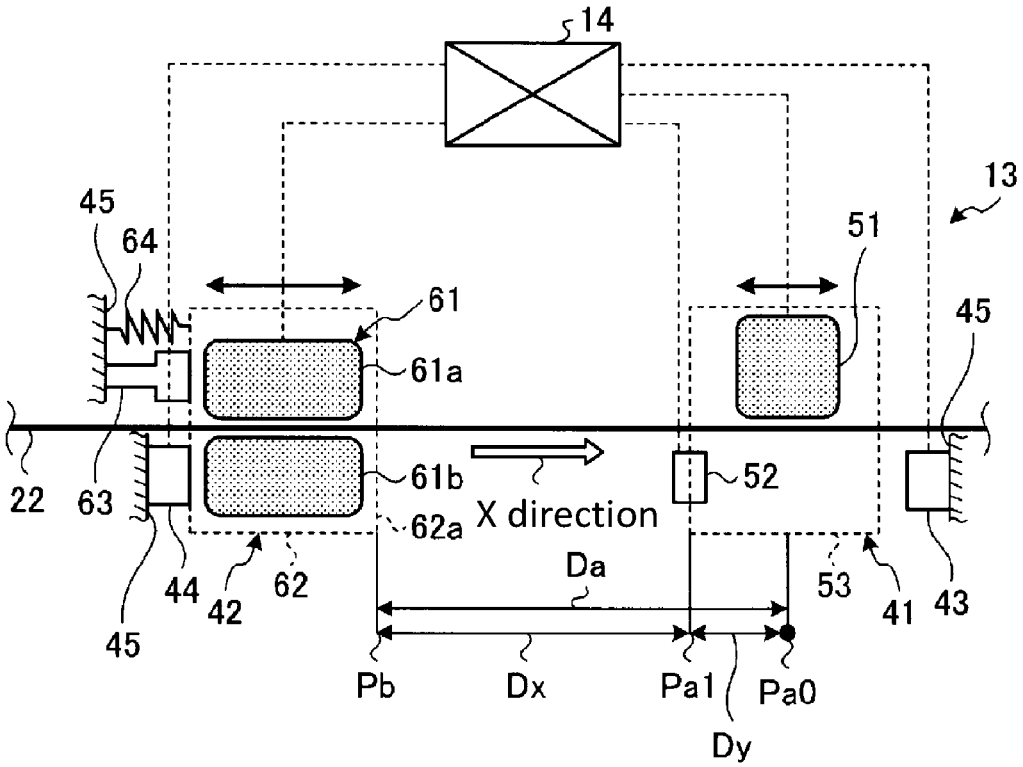
FIG. 2 is a schematic configuration view showing a feed amount correcting unit of the inkjet device according to the present embodiment.
Figure 3:
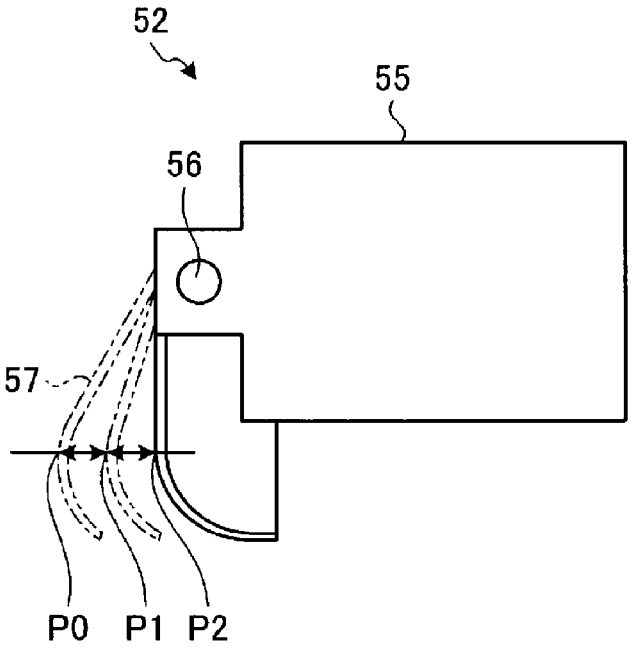
FIG. 3 is a schematic view showing a displacement detection sensor.
Figure 4:
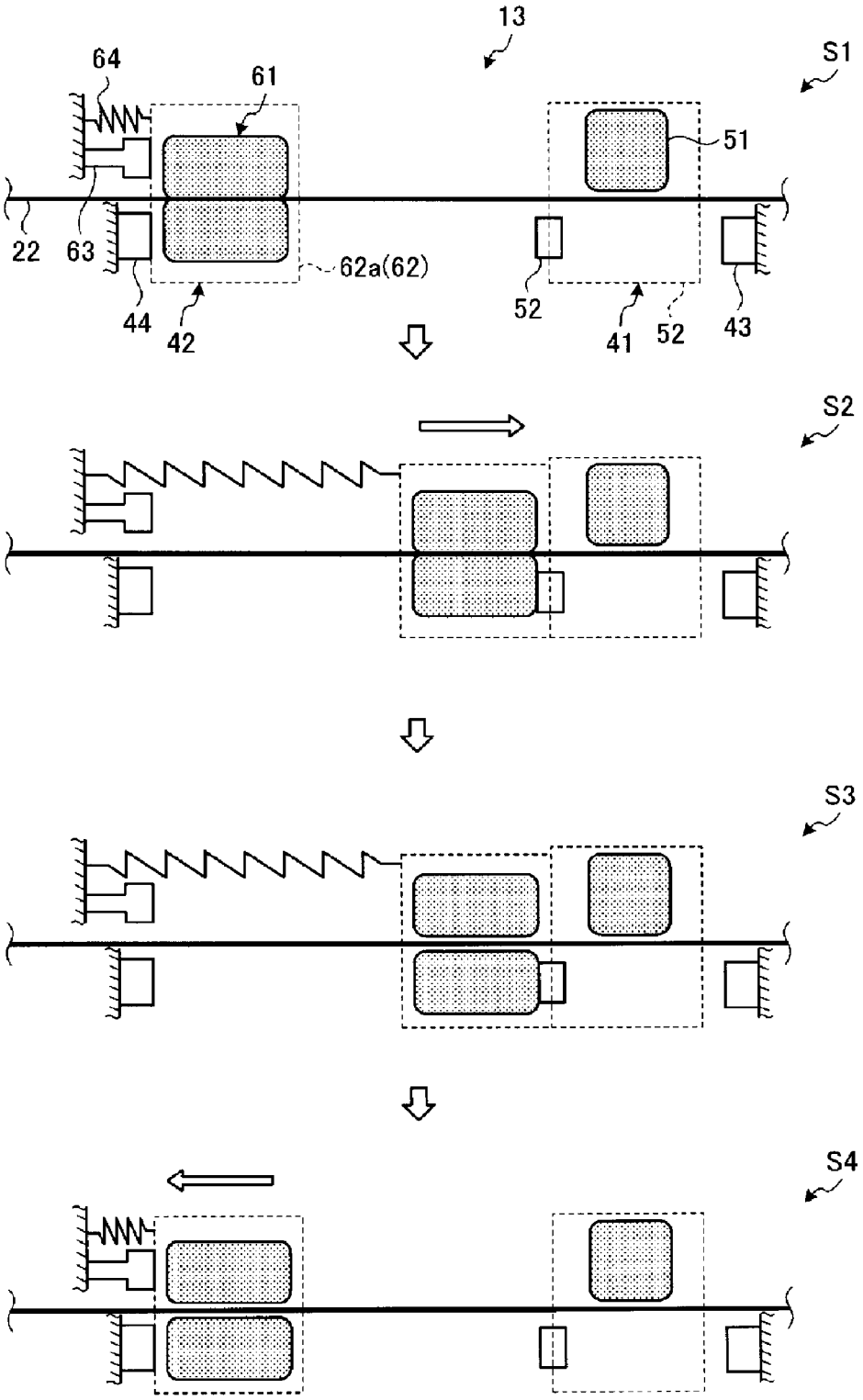
FIG. 4 is a schematic configuration view showing an operation of the feed amount correcting unit.
Figure 5:
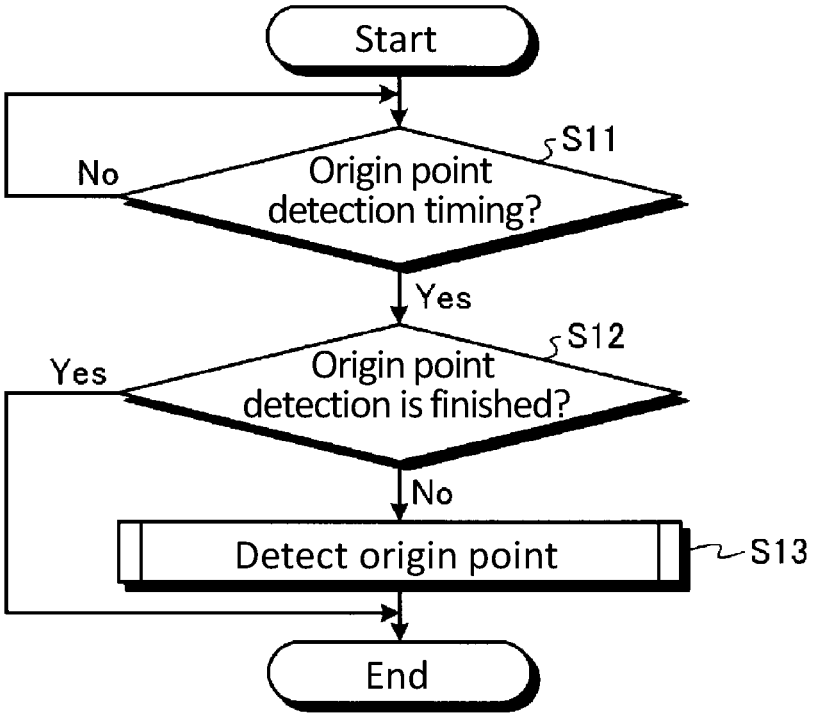
FIG. 5 is a flowchart on one example of a control operation related to an origin point detection timing of a displacement sensor unit.
Figure 6:
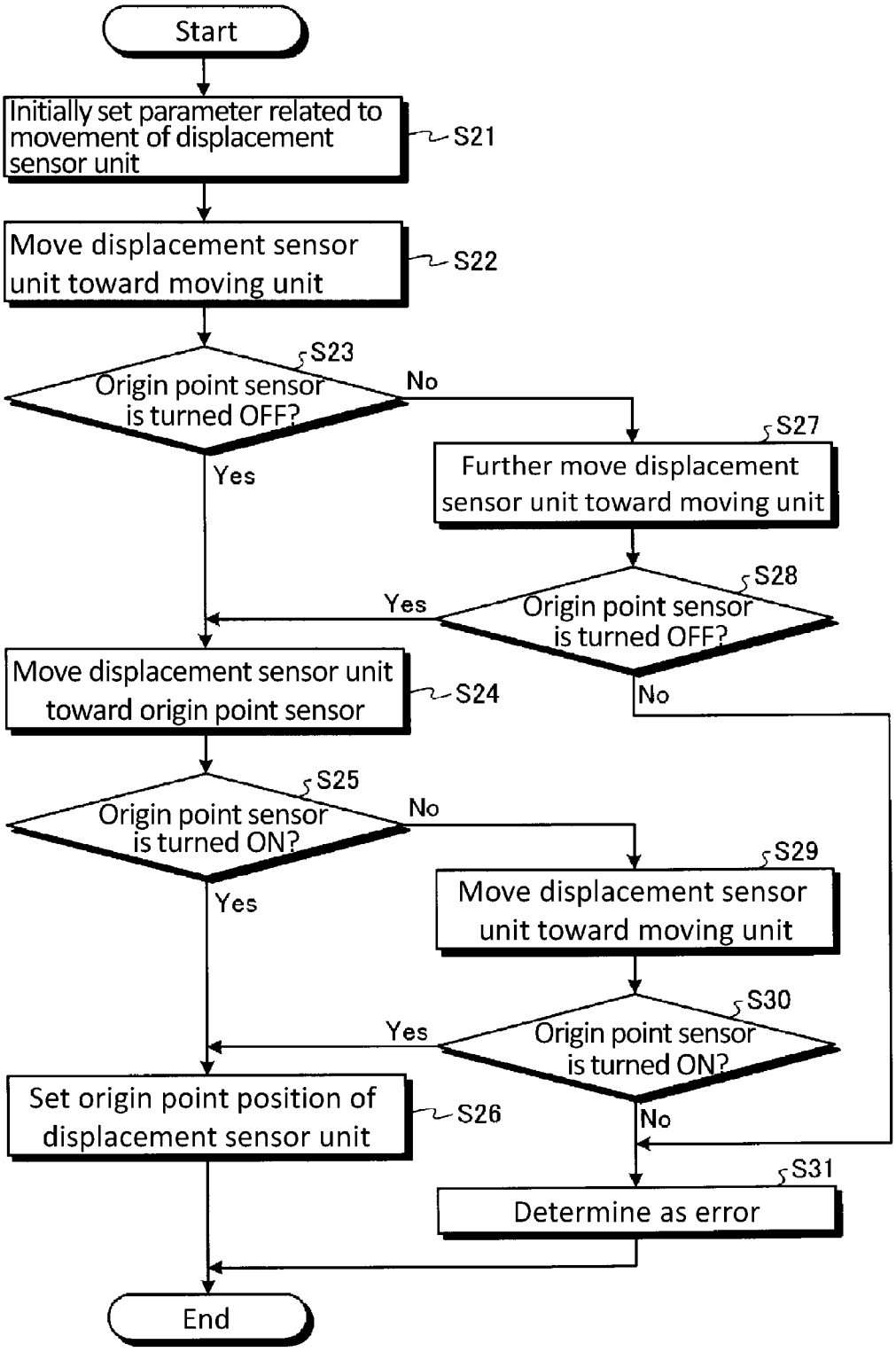
FIG. 6 is a flowchart on one example of a control operation related to an origin point detection of the displacement sensor unit.
Figure 7:
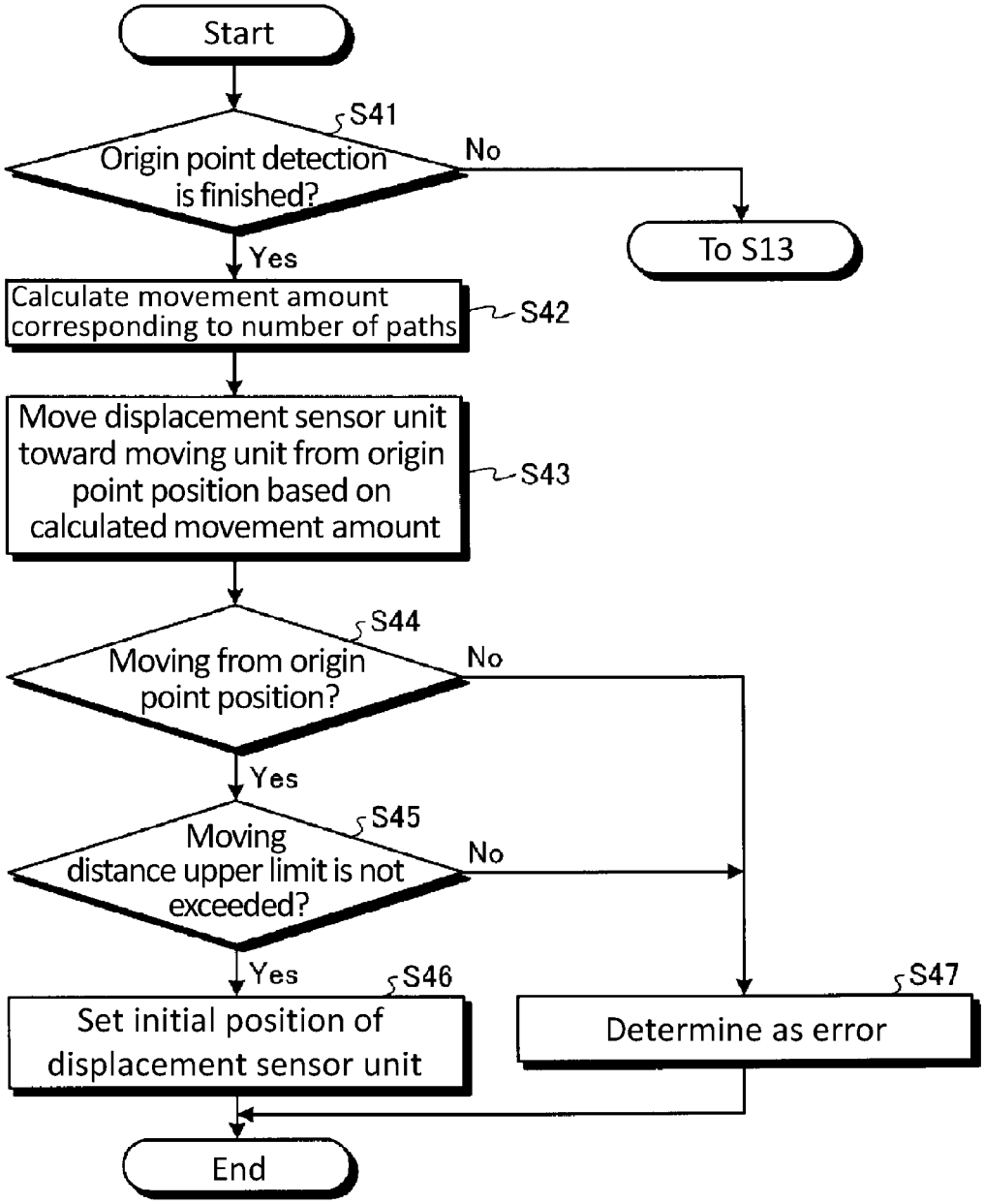
FIG. 7 is a flowchart on one example of a preparatory operation before a feed control.
Figure 8:
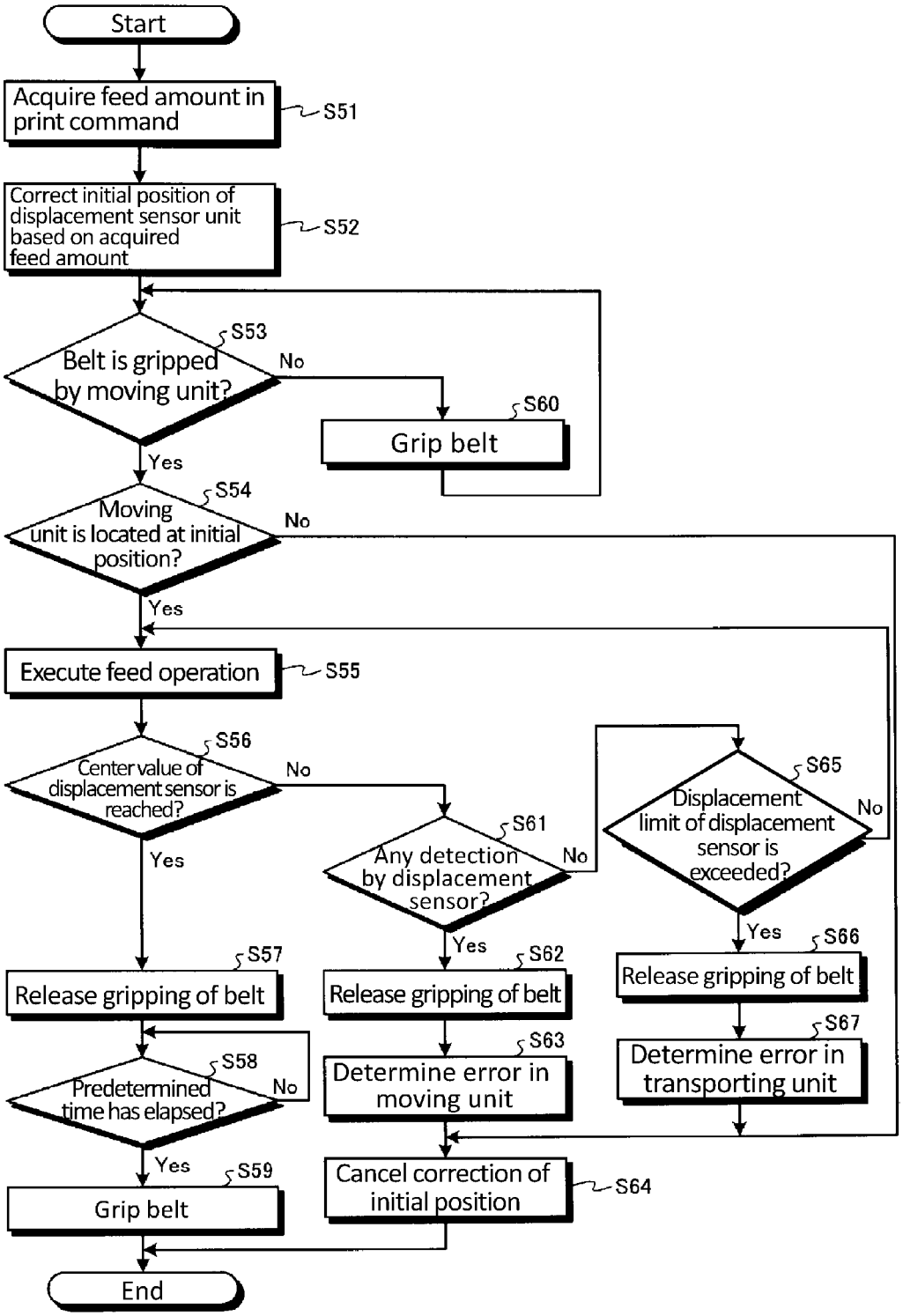
FIG. 8 is a flowchart on one example of a feed control operation.

FIG. 1 is a schematic configuration view showing an inkjet device according to the present embodiment. FIG. 2 is a schematic configuration view showing a feed amount correcting unit of the inkjet device according to the present embodiment. FIG. 3 is a schematic view showing a displacement detection sensor. FIG. 4 is a schematic configuration view showing an operation of the feed amount correcting unit. FIG. 5 is a flowchart on one example of a control operation related to an origin point detection timing of a displacement sensor unit. FIG. 6 is a flowchart on one example of a control operation related to an origin point detection of the displacement sensor unit. FIG. 7 is a flowchart on one example of a preparatory operation before a feed control. FIG. 8 is a flowchart on one example of a feed control operation.

An inkjet device (printing device) 1 according to the present embodiment is a so-called inkjet type printer that discharges an ink liquid droplet from a plurality of nozzles of an inkjet head 33 to print an image of a character, a figure, and the like on a recording medium M such as paper, resin sheet, resin plate, or fabric. The inkjet device 1 transports the recording medium M in the transporting direction by a predetermined feed amount, carries out printing on the transported recording medium M, and thereafter, repeatedly carries out the transportation and the printing of the recording medium M to form an image on the recording medium M.

The inkjet device 1 will be described with reference to FIG. 1. As shown in FIG. 1, the inkjet device 1 includes a transporting unit (transporting section) 11, an inkjet unit (printing section) 12, a feed amount correcting unit (feed amount correcting section) 13, and a control section 14. In FIG. 1, an X direction is assumed as the transporting direction (sub-scanning direction), and a Y direction orthogonal to the X direction is assumed as a main scanning direction. A plane including the X direction and the Y direction is assumed as a horizontal plane, and a Z direction orthogonal to the X direction and the Y direction is assumed as a vertical direction.

The transporting unit 11 includes a plurality of transportation rollers 21, and a transportation belt 22. Among the plurality of transportation rollers 21, rotation axes of at least two transportation rollers 21 are provided in parallel within the horizontal plane. Of the two transportation rollers 21, one transportation roller 21 is a drive roller 21*a* that is rotary driven, and the other transportation roller 21 is a driven roller 21*b*. The drive roller 21*a* is arranged on a front side in the transporting direction, and the driven roller 21*b* is arranged on a back side in the transporting direction. An electric motor 26 is connected to the drive roller 21*a* by way of a power transmission mechanism 25. The electric motor 26 is electrically connected to the control section 14, and rotation controlled by the control section 14.

The transportation belt 22 is an endless belt wound around the plurality of transportation rollers 21. The transportation belt 22 is moved, in a circling manner, around the plurality of transportation rollers 21 on which the belt is wound, and moved toward the transporting direction between the drive roller 21*a* and the driven roller 21*b*. The transportation belt 22 is a horizontal plane between the drive roller 21*a* and the driven roller 21*b*, and has the recording medium M mounted thereon. The transportation belt 22 transports the recording medium M in the transporting direction at between the drive roller 21*a* and the driven roller 21*b*.

The transporting unit 11 has the transportation by the transportation belt 22 controlled as the electric motor 26 is rotation controlled by the control section 14. Specifically, the transporting unit 11 moves the recording medium M by a predetermined feed amount for every path, or transports the recording medium M at a predetermined transporting speed and a predetermined transporting acceleration.

Next, the inkjet unit 12 will be described. The inkjet unit 12 includes a Y bar 31, a carriage 32, an inkjet head 33, and a carriage driving section (not shown).

The Y bar 31 is arranged with a predetermined interval on a vertically upper side of the transportation belt 22. The Y bar 31 is linearly arranged along the main scanning direction parallel to the horizontal direction (Y direction). The Y bar 31 guides the carriage 32 that reciprocates along the main scanning direction.

The carriage 32 is held by the Y bar 31, and can reciprocate in the main scanning direction (Y direction) along the Y bar 31. The carriage 32 is movement controlled in the main scanning direction. The carriage 32 holds a discharging surface of the inkjet head 33 on a surface facing the transportation belt 22 in the vertical direction.

The inkjet head 33 discharges, for example, a printing ink for printing the fabric toward the recording medium M mounted on the transportation belt 22. The inkjet head 33 is mounted on the carriage 32, and can reciprocate in the main scanning direction with the movement of the carriage 32 along the main scanning direction. The inkjet head 33 is connected to an ink tank (not shown) mounted on the carriage 32 by way of, for example, various types of ink flow paths, regulator, pump, and the like. The inkjet head 33 is arranged in plurals according to the type of ink used for the printing on the recording medium M. The inkjet head 33 discharges the ink in the ink tank through the inkjet method toward the recording medium M on the transportation belt 22.

The type of ink includes a variety of inks such as, for example, an ultraviolet curing type ink (UV ink) that cures by an ultraviolet ray, an aqueous ink such as an aqueous sublimation transfer ink, or a solvent type ink such as a solvent ink. Furthermore, a white ink, a coloring ink such as cyan (C), magenta (M), yellow (Y), and black (K), a transparent ink, and the like can be appropriately used for the type of ink according to the hue of the image to be printed. The inkjet head 33 is electrically connected to the control section 14, so that the drive thereof is controlled by the control section 14.

The carriage driving section is a driving device that relatively reciprocates (scans) the carriage 32, that is, the inkjet head 33 in the main scanning direction with respect to the Y bar 31. The carriage driving section is configured to include, for example, a transmission mechanism such as a transportation belt coupled to the carriage 32, and a drive source such as an electrical machinery for driving the transportation belt, converts a power generated by the drive source to a power for moving the carriage 32 along the main scanning direction through the transmission mechanism, and reciprocates the carriage 32 along the main scanning direction. The carriage driving section is electrically connected to the control section 14, so that the drive thereof is controlled by the control section 14.

Next, the feed amount correcting unit 13 will be described with reference to FIG. 1 and FIG. 2. The feed amount correcting unit 13 is arranged on both sides in a width direction orthogonal to the transporting direction of the transportation belt 22 between the drive roller 21*a* and the driven roller 21*b*. The feed amount correcting unit 13 detects a feed amount in the transporting direction of the transportation belt 22 (recording medium M). In the following description, the feed amount correcting units 13 on both sides have a substantially similar configuration, and thus the feed amount correcting unit 13 on one side will be described and the description of the feed amount correcting unit 13 on the other side will be omitted.

The feed amount correcting unit 13 includes a displacement sensor unit (displacement detecting section) 41, and a moving unit (moving section) 42. Furthermore, the feed amount correcting unit 13 includes a displacement origin point sensor (displacement origin point detecting section) 43 that detects an origin point position of the displacement sensor unit 41, and a movement origin point sensor 44 that detects an origin point position of the moving unit 42.

The displacement sensor unit 41 detects a displacement amount of the moving unit 42 in the transporting direction, and is moved such that a position in the transporting direction is at a predetermined position. The displacement sensor unit 41 includes a unit driving section 51, a displacement sensor 52, and a sensor unit frame 53 to which the unit driving section and the displacement sensor are integrally attached. The unit driving section 51 uses, for example, a stepping motor for a power source, and moves the displacement sensor unit 41 in the transporting direction by the rotation of the stepping motor. The unit driving section 51 is electrically connected to the control section 14, so that the drive thereof is controlled by the control section 14.

As shown in FIG. 3, the displacement sensor 52 detects a displacement amount of the moving unit 42 serving as a portion-to-be-detected in the transporting direction. The displacement sensor 52 includes a sensor main body 55, a turning shaft 56, and a claw portion 57. The sensor main body 55 is attached to the sensor unit frame 53, and interiorly includes an encoder for detecting a rotation amount of the claw portion 57. The turning shaft 56 is arranged on the moving unit 42 side of the sensor main body 55, and the claw portion 57 is turned with the turning shaft 56 as the center. The claw portion 57 has the basal part axially attached to the turning shaft 56 and the distal end part provided as a curved free end.

The displacement sensor 52 is electrically connected to the control section 14, and the displacement amount of the moving unit 42 in the transporting direction is detected by the control section 14. Specifically, when the moving unit 42 is brought into contact with the claw portion 57 and the claw portion 57 is turned with the turning shaft 56 as the center in the displacement sensor 52, the rotation amount is detected by the encoder arranged in the sensor main body 55. The detected rotation amount is input to the control section 14, and the control section 14 converts the rotation amount of the claw portion 57 to a displacement amount in the transporting direction to detect the displacement amount of the moving unit 42 in the transporting direction.

The transporting unit 11 is controlled by the control section 14 so that the moving unit 42 that makes contact with the displacement sensor 52 stops at a center position P1 of the maximum displacement amount that can be detected in the transporting direction of the displacement sensor 52. That is, the displacement sensor 52 can detect a minimum value P0, at which the displacement amount becomes 0, a maximum value P2, at which the displacement amount becomes a maximum, and the center value P1, at which the displacement amount becomes a middle displacement amount between the minimum value P0 and the maximum value P2.

The displacement sensor unit 41 configured in such a manner is moved such that the center value P1 of the displacement sensor 52 becomes an origin point position Pa0 detected by the displacement origin point sensor 43, to be described later. Furthermore, the displacement sensor unit 41 is moved so that the center value is at an initial position Pa1 set at the time of initial setting. Furthermore, the displacement sensor unit 41 is microscopically moved from the initial position Pa1 based on the correction of the feed amount.

The moving unit (moving section) 42 grips the transportation belt 22, and moves with the movement of the transportation belt 22. The moving unit 42 is arranged upstream of the transporting direction of the displacement sensor unit 41, and is moved toward the displacement sensor unit 41. The moving unit 42 includes a gripping section 61, a moving unit frame 62, an origin point regulating stopper 63, and a return spring 64.

The gripping section 61 grips and releases an end in a width direction of the transportation belt 22. The gripping section 61 includes an upper grip 61*a* and a lower grip 61*b*, and is arranged so that the transportation belt 22 is located between the upper grip 61*a* and the lower grip 61*b*. The gripping section 61 grips the transportation belt 22 by relatively closely attaching the upper grip 61*a* and the lower grip 61*b* along the vertical direction. The gripping section 61, on the other hand, releases the transportation belt 22 by relatively releasing the upper grip 61*a* and the lower grip 61*b* along the vertical direction. The gripping section 61 is electrically connected to the control section 14, so that the operations related to gripping and releasing of the transportation belt 22 by the gripping section 61 are controlled by the control section 14.

The moving unit frame 62 is attached with the gripping section 61, and is integrally moved with the gripping section 61 in the transporting direction. In the moving unit frame 62, one part on the front side in the transporting direction is a portion-to-be-detected 62*a* that makes contact with the displacement sensor 52.

The origin point regulating stopper 63 is attached to the frame 45 to become a framework of the feed amount correcting unit 13, and is configured, for example, using a hard rubber, and the like. The origin point regulating stopper 63 regulates the position of the moving unit 42 returning in the opposite direction of the transporting direction to an origin point position Pb. The origin point position Pb of the moving unit 42 is the same position as the initial position set at the time of initial setting.

The return spring 64 is a tension coil spring, where one end of which is attached to the frame 45, and the other end is connected to the moving unit frame 62 of the moving unit 42. The return spring 64 moves the moving unit 42 to the origin point position Pb by its elastic force.

The displacement origin point sensor 43 is attached to the frame 45, similar to the origin point regulating stopper 63. The displacement origin point sensor 43, for example, uses a photo-interpreter, and detects the origin point position Pa0 of the displacement sensor unit 41. Specifically, the displacement origin point sensor 43 detects whether or not the sensor unit frame 53 is at the origin point position Pa0. The displacement origin point sensor 43 is electrically connected to the control section 14, detects whether or not the position of the displacement sensor unit 41 in the transporting direction is at the origin point position Pa0, and outputs the detection result toward the control section 14.

The movement origin point sensor 44 is attached to the frame 45, similar to the origin point regulating stopper 63 and the displacement origin point sensor 43. The movement origin point sensor 44 detects the origin point position Pb of the moving unit 42. Specifically, the movement origin point sensor 44 detects whether or not the position of the portion-to-be-detected 62*a* of the moving unit frame 62 is at the origin point position Pb. The movement origin point sensor 44 is electrically connected to the control section 14, detects whether or not the position of the moving unit 42 in the transporting direction is at the origin point position Pb, and outputs the detection result toward the control section 14.

A basic operation of the feed amount correcting unit 13 will now be described with reference to FIG. 4. Before the transportation of the transportation belt 22 by the transporting unit 11, the displacement sensor unit 41 and the portion-to-be-detected 62*a* of the moving unit 42 are located at the initial positions Pa1, Pb, respectively. From such a state, the control section 14 causes the gripping section 61 of the moving unit 42 to carry out the gripping operation to grip the transportation belt 22 with the gripping section 61 (step S1). Thereafter, the control section 14 transports the transportation belt 22, and moves the moving unit 42 (gripping section 61 and moving unit frame 62) toward the displacement sensor unit 41. When the displacement amount in the transporting direction of the moving unit 42 is detected by the displacement sensor 52 of the displacement sensor unit 41, the control section 14 controls the movement of the transportation belt 22 of the transporting unit 11 so that the detected displacement amount becomes the center value P1 (step S2). The control section 14 stops the moving unit 42 at the center value P1 of the displacement sensor 41, and then releases the gripping of the transportation belt 22 by the gripping section 61 (step S3). Then, the moving unit 42 is moved in the opposite direction of the transporting direction by the elastic force of the return spring 64, and the portion-to-be-detected 62*a* of the moving unit 42 is returned to the initial position (origin point position) Pb (step S4). Thus, the distance from the initial position Pb to the initial position Pa1 becomes the feed amount of the recording medium M.

Next, the control section 14 will be described. The control section 14 controls each section including the transporting unit 11, the inkjet unit 12, and the feed amount correcting unit 13. The control section 14 is configured by hardware such as an arithmetic device and a memory, and program for realizing predetermined functions thereof. The control section 14 controls the inkjet head 33, and controls discharging amount, discharge timing, discharging period, and the like of the ink. The control section 14 controls the carriage driving section, and controls the relative movement of the carriage 32 along the main scanning direction. The control section 14 controls the electric motor 26 of the transporting unit 11 based on the detection results of the displacement sensor 52 and the movement origin point sensor 44, and controls the movement of the transportation belt 22 along the transporting direction. The control section 14 controls the unit driving section 51 of the displacement sensor unit 41 based on the detection result of the displacement origin point sensor 43, and controls the movement along the transporting direction.

Next, an operation related to the control of the feed amount by the transporting unit 11 of the inkjet device 1 will be described with reference to FIG. 5 to FIG. 8.

First, timing to detect the origin point position Pa0 of the displacement sensor unit 41 will be described with reference to FIG. 5. The control section 14 determines whether or not timing (origin point detection timing) to detect (origin point detection) the origin point position Pa0 of the displacement sensor unit 41 is reached (step S11). The origin point detection timing is, for example, time of turning ON the power of the inkjet device 1, time of returning from the sleep state of the inkjet device 1, time of returning after the maintenance of the inkjet device 1. The origin point detection timing is not particularly limited to the above timing as long as it is when the origin point position Pa0 of the displacement sensor unit 41 is undetected and is an appropriate timing at which printing failure does not occur.

When determining that the origin point detection timing is reached in step S11 (step S11: Yes), the control section 14 determines whether or not the origin point detection of the displacement sensor unit 41 is finished (step S12). When determining that the origin point detection timing is not reached in step S11 (step S11: No), on the other hand, the control section 14 repeatedly executes step S11 until the origin point detection timing is reached.

When determining that the origin point detection is finished in step S12 (step S12: Yes), the control section 14 terminates the operation of FIG. 5 without carrying out the origin point detection of the displacement sensor unit 41. When determining that the origin point detection is not finished in step S12 (step S12: No), on the other hand, the control section 14 executes the origin point detection of the displacement sensor unit 41 (step S13). After the execution of step S13, the control unit 14 sets as a state in which the origin point detection of the displacement sensor unit 41 is finished, and terminates the operation of FIG. 5.

Next, an operation of detecting the origin point position Pa0 of the displacement sensor unit 41 will be described with reference to FIG. 6. The operation related to the origin point detection of the displacement sensor unit 41 shown in FIG. 6 is the operation executed in step S13 of FIG. 5. That is, the displacement sensor unit 41 is in a state where the origin point position Pa0 is undetected.

The control section 14 initially sets a parameter related to the movement of the displacement sensor unit 41 in the transporting direction (step S21). The parameter includes, for example, a moving speed and a moving acceleration of the displacement sensor unit 41. Then, the control section 14 controls the unit driving section 51 based on the acquired parameter, and moves the displacement sensor unit 41 toward the moving unit 42 (step S22). That is, the control section 14 moves the displacement sensor unit 41 in an opposite direction of the transporting direction of moving away from the displacement origin point sensor 43.

After the execution of step S22, the control section 14 determines whether or not the detection by the displacement origin point sensor 43 is turned OFF (step S23). When determining that the detection by the displacement origin point sensor 43 is turned OFF in step S23 (step S23: Yes), the control section 14 then moves the displacement sensor unit 41 toward the displacement origin point sensor 43 (step S24). That is, the control section 14 moves the displacement sensor unit 41 in the transporting direction of moving closer to the displacement origin point sensor 43.

After the execution of step S24, the control section 14 determines whether or not the detection by the displacement origin point sensor 43 is turned ON (step S25). When determining that the detection by the displacement origin point sensor 43 is turned ON in step S25 (step S25: Yes), the control section 14 sets the position of the displacement sensor unit 41, which detection is turned ON, that is, the position of the center value P1 of the displacement sensor 52 as the origin point position Pa0 (step S26). The origin point position Pa0 becomes a reference position where the position of the displacement sensor unit 41 becomes zero. After the execution of step S26, the control section 14 terminates the operation related to the origin point detection of the displacement sensor unit 41.

When determining that the detection by the displacement origin point sensor 43 is not turned OFF in step S23 (step S23: No), the control section 14 again controls the unit driving section 51, and moves the displacement sensor unit 41 toward the moving unit 42 (step S27).

After the execution of step S27, the control section 14 again determines whether or not the detection by the displacement origin point sensor 43 is turned OFF (step S28). When determining that the detection by the displacement origin point sensor 43 is turned OFF in step S28 (step S28: Yes), the control section 14 proceeds to step S24. When determining that the detection by the displacement origin point sensor 43 is not turned OFF in step S28 (step S28: No), on the other hand, the control section 14 determines that an error occurred (step S31), and terminates the operation related to the origin point detection of the displacement sensor unit 41.

When determining that the detection by the displacement origin point sensor 43 is not turned ON in step S25 (step S25: No), the control section 14 again controls the unit driving section 51, and moves the displacement sensor unit 41 toward the displacement origin point sensor 43 (step S29).

After the execution of step S29, the control section 14 again determines whether or not the detection by the displacement origin point sensor 43 is turned ON (step S30). When determining that the detection by the displacement origin point sensor 43 is turned ON in step S30 (step S30: Yes), the control section 14 proceeds to step S26. When determining that the detection by the displacement origin point sensor 43 is not turned ON in step S30 (step S30: No), on the other hand, the control section 14 determines that an error occurred (step S31), and terminates the operation related to the origin point detection of the displacement sensor unit 41.

Now, a preparatory operation before the feed control of controlling the feed amount of the recording medium M by the transporting unit 11 will be described with reference to FIG. 7. The preparatory operation before the feed control is, for example, executed after the print command for preparing for printing is input and before the printing is started. The preparatory operation before the feed control is, a so-called, operation for initially setting the feed amount.

When the print command for preparing for the printing is input, the control section 14 determines whether or not the origin point detection of the displacement sensor unit 41 is finished (step S41). When determining that the origin point detection of the displacement sensor unit 41 is not finished in step S41 (step S41: No), the control section 14 proceeds to step S13, and executes the operation related to the origin point detection of the displacement sensor unit 41.

When determining that the origin point detection of the displacement sensor unit 41 is finished in step S41 (step S41: Yes), the control section 14 calculates a movement amount (differential movement amount) Dy for initially setting the feed amount of the recording medium M from the following calculation formula based on information on the number of paths in the print command (step S42).

$$Dy = Da - L/\text{number of paths} \quad (1)$$

Dy: movement amount,

Da: origin point defined distance,

L: length set based on specification (e.g., the number of nozzles) of inkjet head 33

The movement amount Dy is a distance in which the displacement sensor unit 41 moves from the origin point position Pa0 to the initial position Pa1. The origin point defined distance Da is a distance between the origin point position Pa0 of the displacement sensor unit 41 and the initial position Pb of the moving unit 42. The length L is a length set based on the specification of the inkjet head 33, as described above, and is changed depending on the type of inkjet head 33 to be used. The number of paths is the number of prints made by the inkjet head 33 on the printing region of the recording medium M.

After calculating the movement amount Dy in step S42, the control section 14 moves the displacement sensor unit 41 toward the moving unit 42 from the origin point position Pa0 by the calculated movement amount Dy (step S43). Then, as shown in FIG. 2, the distance or a difference obtained by subtracting the movement amount Dy from the origin point defined distance Da becomes a set feed amount Dx to be initially set. That is, the length calculated according to the specification of the inkjet head 33 and the number of paths becomes the set feed amount Dx.

The origin point defined distance Da may use a mechanical set value, but the value of the origin point defined distance Da is preferably adjusted in the following manner if an individual difference arises in a mechanical precision. First, the displacement sensor unit 41 is moved from the origin point position Pa0 toward the moving unit 42, and the actual movement amount of the displacement sensor unit 41 of when the displacement sensor 52 is brought into contact with the portion-to-be-detected 62*a* and the displacement amount of the displacement sensor 52 becomes the center value P1 is obtained. Next, a difference between the mechanical set value and the value of the actual movement amount is obtained, and the relevant difference is added to the mechanical set value to adjust the value of the origin point defined distance Da. The individual difference value that arises between the devices is thereby absorbed.

After the execution of step S43, the control section 14 determines whether or not the displacement sensor unit 41 is moving from the origin point position Pa0 (step S44). When determining that the displacement sensor unit 41 is moving from the origin point position Pa0 in step S44 (step S44: Yes), the control section 14 determines whether or not a moving distance upper limit to become the upper limit movement amount set in advance is not exceeded (step S45).

When determining that the moving distance upper limit to become the upper limit movement amount set in advance is not exceeded in step S45 (step S45: Yes), the control section 14 sets the position of the displacement sensor unit 41 after the movement as the initial position Pa1 (step S46). After the execution of step S46, the control section 14 terminates the preparatory operation before the feed control of the displacement sensor unit 41.

When determining that the displacement sensor unit 41 is not moving from the origin point position Pa0 in step S44 (step S44: No), or when determining that the moving distance upper limit to become the upper limit movement amount set in advance is exceeded in step S45 (step S45: No), on the other hand, the control section 14 determines that an error occurred (step S47), and terminates the preparatory operation before the feed control of the displacement sensor unit 41.

An operation of the feed control for controlling the feed amount of the recording medium M by the transporting unit 11 will now be described with reference to FIG. 8. The feed control operation is, for example, executed when the print command for executing the printing is input. That is, the feed control operation is an operation for setting the feed amount at the time of printing. The feed control operation shown in FIG. 8 is repeatedly executed for every path.

When the print command for executing the printing is input, the control section 14 acquires the feed amount for every path in the print command (step S51). The feed amount for every path in the print command becomes the feed amount at which correction is performed, and may be different from the set feed amount set at the time of initial setting (time of print preparation).

After acquiring the feed amount in step S51, the control section 14 corrects the initial position Pa1 of the displacement sensor unit 41 based on the acquired feed amount (step S52). Specifically, the control section 14 calculates a differential feed amount (difference) of the previously-set set feed amount and the acquired feed amount. Thereafter, the control section 14 controls the unit driving section 51 of the displacement sensor unit 41 based on the calculated differential feed amount, and microscopically moves the displacement sensor unit 41 from the current position by the differential feed amount along the transporting direction to correct the initial position Pa1 of the displacement sensor unit 41. Then, the control section 14 sets the feed amount to become the distance between the initial position Pa1 after the correction and the origin point position Pb as the set feed amount.

After the execution of step S52, the control section 14 determines whether or not the transportation belt 22 is gripped by the gripping section 61 of the moving unit 42 (step S53). When determining that the transportation belt 22 is gripped by the gripping section 61 in step S53 (step S53: Yes, step S1 of FIG. 4), the control section 14 determines whether or not the moving unit 42 is located at the initial position Pb based on the detection result of the movement origin point sensor 44 (step S54).

When determining that the moving unit 42 is located at the initial position Pb in step S54 (step S54: Yes), the control section 14 executes the feed control operation (step S55, step S2 of FIG. 4). When transporting the recording medium M with the transporting unit 11 based on the set feed amount after the correction, the control section 14 decelerates a post-detection transporting speed after the displacement detection of the moving unit 42 in comparison with a pre-detection transporting speed before the displacement detection of the moving unit 42. That is, the control section 14 transports the recording medium M with the transporting unit 11 at the pre-detection transporting speed, which is a high speed, when the moving unit 42 is moved from the origin point position Pb, and thereafter, transports the recording medium M with the transporting unit 11 at the post-detection transporting speed, which is a low speed, after the displacement detection by the displacement sensor 52. The control section 14 switches from the pre-detection transporting speed to the post-detection transporting speed at the timing of during the detection or before the detection by the displacement sensor 52.

After the execution of step S55, the control section 14 determines whether or not the displacement amount of the displacement sensor 52 reached the center value P1 (step S56). When determining that the displacement amount of the displacement sensor 52 reached the center value P1 in step S56 (step S56: Yes), the control section 14 stops the transportation of the recording medium M by the transporting unit 11, and releases the gripping of the transportation belt 22 by the gripping section 61 of the moving unit 42 (step S57, step S3 of FIG. 4). When the gripping of the transportation belt 22 is released, the moving unit 42 is moved to the origin point position Pb by the return spring 64 (step S4 of FIG. 4).

After the execution of step S57, the control section 14 determines whether or not a predetermined time set in advance has elapsed (step S58). The predetermined time is a sufficient time for the moving unit 42 to return to the origin point position Pb after the gripping by the gripping section 61 is released. When determining that the predetermined time has elapsed in step S58 (step S58: Yes), the control section 14 causes the transportation belt 22 to be gripped with the gripping section 61 to be in a standby state of the next feed control operation (step S59). When determining that the predetermined time has not elapsed in step S58 (step S58: No), on the other hand, the control section 14 repeatedly executes step S58 until the elapse of the predetermined time. After the execution of step S59, the control section 14 terminates the feed control operation of the feed amount correcting unit 13.

When determining that the transportation belt 22 is not gripped by the gripping section 61 in step S53 (step S53: No), the control section 14 causes the transportation belt 22 to be gripped with the gripping section 61 (step S60). After the execution of step S60, the control section 14 repeatedly executes step S53 and step S60 until the transportation belt 22 is gripped by the gripping section 61.

Furthermore, when determining that the moving unit 42 is not located at the initial position Pb in step S54, the control section 14 cancels the correction of the initial position Pa1 of the displacement sensor unit 41 (step S64), and terminates the feed control operation of the feed amount correcting unit 13.

Furthermore, when determining that the displacement amount of the displacement sensor 52 has not reached the center value P1 in step S56 (step S56: No), the control section 14 determines whether or not detection of the displacement amount by the displacement sensor 52 is made (step S61). When determining that the detection of the displacement amount by the displacement sensor 52 is not made in step S61 (step S61: Yes), the control section 14 releases the gripping of the transportation belt 22 by the gripping section 61 (step S62), determines that error occurred in the moving unit 42 (step S63), and proceeds to step S64. The error in the moving unit 42 includes, for example, slip of the transportation belt 22 at the gripping section 61, and the like.

When determining that the detection of the displacement amount by the displacement sensor 52 is made in step S61 (step S61: No), on the other hand, the control section 14 determines whether or not a displacement limit of the displacement sensor 52 is exceeded, that is, whether or not the maximum value P2 of the displacement amount of the displacement sensor 52 is exceeded (step S65). When determining that the displacement limit of the displacement sensor 52 is exceeded (step S65: Yes), the control section 14 releases the gripping of the transportation belt 22 by the gripping section 61 (step S66), determines that error occurred in the transporting unit 11 (step S67), and proceeds to step S64. The error in the transporting unit 11 includes, for example, excessive transportation due to failure in the power transmission mechanism 25 or the electric motor 26, and the like.

When determining that the displacement limit of the displacement sensor 52 is not exceeded in step S65 (step S65: No), the control section 14 proceeds to step S55 assuming the feed operation by the transporting unit 11 is being executed, and continuously executes the feed operation.

Therefore, according to the present embodiment, the set feed amount can be corrected by position correcting the initial position Pa1 of the displacement sensor unit 41 so as to be the feed amount acquired at the time of printing, as shown in FIG. 8. Then, the moving unit 42 is moved toward the displacement sensor unit 41, and the transportation of the recording medium M is controlled so that the recording medium M becomes the set feed amount based on the displacement amount detected by the displacement sensor 52 to transport the recording medium M at satisfactory precision. In this case, the displacement sensor such as the encoder is arranged on the moving unit 42 so that the distance during the movement does not need to be measured, whereby the configuration can be simplified, and the cost of the feed amount correcting unit 13 can be reduced by the simplified configuration.

Furthermore, according to the present embodiment, the set feed amount at the time of the initial setting can be set according to the number of paths at the time of printing, so that the recording medium M can be transported at the set feed amount suited for the number of paths.

Moreover, according to the present embodiment, the displacement sensor unit 41 is moved by the movement amount Dy, obtained by subtracting the set feed amount Dx calculated according to the specification of the inkjet head 33 and the number of paths from the origin point defined distance Da, at the time of the initial setting so that the displacement sensor unit 41 can be appropriately moved to the initial position Pa1 to become the set feed amount Dx.

According to the present embodiment, the moving unit 42 can be moved at the post-detection transporting speed, which is the low speed, at the time of the detection by the displacement sensor 52. Thus, the detection of the displacement amount of the moving unit 42 by the displacement sensor 52 can be stably carried out. Furthermore, the movement of the moving unit 42 can be suppressed from exceeding the maximum value P2 of the displacement amount and the moving unit 42 from physically making contact with another portion.

According to the present embodiment, in the displacement sensor 52, the moving unit 42 is brought into contact with the claw portion 57 so that the claw portion 57 is moved with the turning shaft 56 as the center, whereby the movement amount in the transporting direction can be detected as the displacement amount.

Furthermore, according to the present embodiment, the feed amount of the recording medium M can be corrected by the feed amount correcting unit 13, and the recording medium M can be transported by the transporting unit 11 at satisfactory precision. Thus, the image can be printed with satisfactory precision on the transported recording medium M with the inkjet unit 12, and occurrence of print failure such as print line, and the like can be suppressed.

What is claimed is:

1. A printing device, comprising:

a transporting section that transports a recording medium in a transporting direction;

a printing section that carries out printing on the recording medium which is transported;

a feed amount correcting section that corrects a feed amount in the transporting direction of the recording medium transported by the transporting section; and a control section that controls the transporting section and the feed amount correcting section, wherein the feed amount correcting section comprises:

a moving section that moves with a movement of the recording medium in the transporting direction; and a displacement detecting section that detects a displacement amount of the moving section, a distance between the displacement detecting section at an initial position before a transportation and the moving section at an initial position before a transportation is a set feed amount set in advance, and the control section controls the feed amount of the recording medium based on a difference between the feed amount acquired at a time of printing of the printing section and the set feed amount set in advance.

2. The printing device according to claim 1, wherein
the set feed amount is set according to a number of paths at the time of the printing of the printing section during a time of initial setting.

3. The printing device according to claim 1, wherein
the control section carries out position correction on the initial position of the displacement detecting section based on the difference between the feed amount acquired at the time of printing of the printing section and the set feed amount set in advance, so as to obtain the set feed amount after a correction,
the moving section is moved toward the displacement detecting section at a time of the transportation, and
the control section controls the transporting section, so that the feed amount of the recording medium becomes the set feed amount after the correction based on the displacement amount detected by the displacement detecting section of the moving section which moves.

4. The printing device according to claim 2, wherein
the control section carries out position correction on the initial position of the displacement detecting section based on the difference between the feed amount acquired at the time of printing of the printing section and the set feed amount set in advance, so as to obtain the set feed amount after a correction,
the moving section is moved toward the displacement detecting section at a time of the transportation, and
the control section controls the transporting section, so that the feed amount of the recording medium becomes the set feed amount after the correction based on the displacement amount detected by the displacement detecting section of the moving section which moves.

5. The printing device according to claim 3, further comprising:
a displacement origin point detecting section that detects an origin point position of the displacement detecting section, wherein
a distance between the displacement detecting section at the origin point position and the moving section at the initial position is an origin point defined distance, and
the control section calculates a differential movement amount obtained by subtracting the set feed amount from the origin point defined distance, and sets a position to where the displacement detecting section is moved from the origin point position by the differential movement amount as the initial position of the displacement detecting section.

6. The printing device according to claim 4, further comprising:
a displacement origin point detecting section that detects an origin point position of the displacement detecting section, wherein
a distance between the displacement detecting section at the origin point position and the moving section at the initial position is an origin point defined distance, and
the control section calculates a differential movement amount obtained by subtracting the set feed amount from the origin point defined distance, and sets a position to where the displacement detecting section is moved from the origin point position by the differential movement amount as the initial position of the displacement detecting section.

7. The printing device according to claim 1, wherein
the control section decelerates a post-detection transporting speed after a displacement detection of the moving section in comparison with a pre-detection transporting speed before a displacement detection of the moving section based on the set feed amount during a transportation operating of the recording medium.

8. The printing device according to claim 2, wherein
the control section decelerates a post-detection transporting speed after a displacement detection of the moving section in comparison with a pre-detection transporting speed before a displacement detection of the moving section based on the set feed amount during a transportation operating of the recording medium.

9. The printing device according to claim 3, wherein
the control section decelerates a post-detection transporting speed after a displacement detection of the moving section in comparison with a pre-detection transporting speed before a displacement detection of the moving section based on the set feed amount during a transportation operating of the recording medium.

10. The printing device according to claim 4, wherein
the control section decelerates a post-detection transporting speed after a displacement detection of the moving section in comparison with a pre-detection transporting speed before a displacement detection of the moving section based on the set feed amount during a transportation operating of the recording medium.

11. The printing device according to claim 5, wherein
the control section decelerates a post-detection transporting speed after a displacement detection of the moving section in comparison with a pre-detection transporting speed before a displacement detection of the moving section based on the set feed amount during a transportation operating of the recording medium.

12. The printing device according to claim 6, wherein
the control section decelerates a post-detection transporting speed after a displacement detection of the moving section in comparison with a pre-detection transporting speed before a displacement detection of the moving section based on the set feed amount during a transportation operating of the recording medium.

13. The printing device according to claim 1, wherein the displacement detecting section comprises:
a turning shaft; and
a claw portion that rotates with the turning shaft as the center,
wherein the control section detects a movement amount of the claw portion in the transporting direction as the displacement amount.

14. The printing device according to claim 2, wherein the displacement detecting section comprises:
a turning shaft; and
a claw portion that rotates with the turning shaft as the center,
wherein the control section detects a movement amount of the claw portion in the transporting direction as the displacement amount.

15. The printing device according to claim 3, wherein the displacement detecting section comprises:
a turning shaft; and
a claw portion that rotates with the turning shaft as the center,
wherein the control section detects a movement amount of the claw portion in the transporting direction as the displacement amount.

16. The printing device according to claim 4, wherein the displacement detecting section comprises:
a turning shaft; and
a claw portion that rotates with the turning shaft as the center, wherein the control section detects a movement amount of the claw portion in the transporting direction as the displacement amount.

17. The printing device according to claim 5, wherein the displacement detecting section comprises:

a turning shaft; and a claw portion that rotates with the turning shaft as the center, wherein the control section detects a movement amount of the claw portion in the transporting direction as the displacement amount.

18. The printing device according to claim 6, wherein the displacement detecting section comprises:

a turning shaft; and a claw portion that rotates with the turning shaft as the center, wherein the control section detects a movement amount of the claw portion in the transporting direction as the displacement amount.

19. The printing device according to claim 7, wherein the displacement detecting section comprises:

a turning shaft; and a claw portion that rotates with the turning shaft as the center, wherein the control section detects a movement amount of the claw portion in the transporting direction as the displacement amount.

20. The printing device according to claim 8, wherein the displacement detecting section comprises:

a turning shaft; and a claw portion that rotates with the turning shaft as the center, wherein the control section detects a movement amount of the claw portion in the transporting direction as the displacement amount.

* * * * *